US008507782B2

(12) United States Patent
Takehisa et al.

(10) Patent No.: US 8,507,782 B2
(45) Date of Patent: Aug. 13, 2013

(54) ELECTRONIC PERCUSSION INSTRUMENT

(75) Inventors: Hideaki Takehisa, Hamamatsu (JP); Yasuharu Katagiri, Hamamatsu (JP); Mikihiro Hiramatsu, Hamamatsu (JP); Makoto Katsuura, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 466 days.

(21) Appl. No.: 12/820,891

(22) Filed: Jun. 22, 2010

(65) Prior Publication Data

US 2010/0319519 A1 Dec. 23, 2010

(30) Foreign Application Priority Data

Jun. 22, 2009 (JP) ..... 2009-147442

(51) Int. Cl.
*G10H 7/00* (2006.01)

(52) U.S. Cl.
USPC ..... 84/626; 84/658; 84/633

(58) Field of Classification Search
USPC ..... 84/626, 633, 645, 653, 658, 662
See application file for complete search history.

(56) References Cited

U.S. PATENT DOCUMENTS 4,781,097 A * 11/1988 Uchiyama et al. ..... 84/738
4,899,633 A * 2/1990 Lombardi ..... 84/730
5,076,131 A * 12/1991 Patterson ..... 84/421
5,824,938 A * 10/1998 Costello et al. ..... 84/687
7,795,518 B2 * 9/2010 Yoshino et al. ..... 84/411 R
2009/0241755 A1 * 10/2009 Yoshino et al. ..... 84/421
2010/0319519 A1 * 12/2010 Takehisa et al. ..... 84/723

FOREIGN PATENT DOCUMENTS

JP 2002-182643 A 6/2002

* cited by examiner

*Primary Examiner* — David S. Warren
(74) *Attorney, Agent, or Firm* — Morrison & Foerster LLP

(57) ABSTRACT

An electronic percussion instrument generates, in accordance with a trigger signal output from a pad source, a musical performance tone of a tone color assigned to the pad source. The electronic percussion instrument includes a program memory for storing a control program and a CPU for controlling operation of the electronic percussion instrument in accordance with the control program stored in the program memory. A storage device is also provided for storing a plurality of trigger data sets each of which includes at least one sensitivity setting parameter for setting sensitivity to the trigger signal, and a plurality of drum kits each of which includes pad setting data for setting the tone color assigned to the at least one pad source and link data for designating one of the plurality of trigger data sets. A setting operation input unit is provided for selecting a drum kit from among the plurality of drum kits. The CPU is coupled to the storage device and the setting operation input unit and operative under the control program for setting the sensitivity to the trigger signal on the basis of the at least one sensitivity setting parameter included in the trigger data set designated by the link data included in the drum kit selected by the setting operation input unit.

17 Claims, 6 Drawing Sheets

ELECTRONIC PERCUSSION INSTRUMENT

BACKGROUND OF THE INVENTION

1. Field of the Invention

The present invention relates to an electronic percussion instrument which generates an electronic musical performance tone in response to a user's musical operation such as striking a pad.

2. Description of the Related Art

There is a conventional electronic drum set disclosed in Japanese Unexamined Patent Publication No. 2002-182643, for example. The conventional electronic drum set is designed such that by the user's operation of a drum kit assignment button, a certain combination of tone colors are respectively assigned to a plurality of pads all at once. The conventional electronic drum set is also designed such that, in manually selecting hand-percussion mode (not a drum kit selection), settings of the sensitivity of at least one performance operating member are automatically made.

SUMMARY OF THE INVENTION

The above-described conventional electronic percussion instrument requires a user to do separate procedures of selecting a drum kit for tone color assignments and setting the sensitivity (settings of the hand-percussion mode), thus forcing the user to do complicated procedures. In a case where the user desires to set respective sensitivities of plural pads, particularly, the conventional electronic percussion instrument is disadvantageous. In paragraph 0003 of the above-described Japanese Unexamined Patent Publication No. 2002-182643, there is a description that a selection of a drum kit does not cause changes in sensitivity.

An embodiment of the present invention provides an electronic percussion instrument which generates, in accordance with trigger signals generated by a plurality of pad sources, musical performance tones of tone colors assigned to the pad sources, respectively, the electronic percussion instrument allowing a user to set both the tone colors and the respective sensitivities of the pad sources all at once.

An embodiment of the present invention provides an electronic percussion instrument which generates, in accordance with a trigger signal output from at least one pad source, a musical performance tone of a tone color assigned to the at least one pad source. The electronic percussion instrument includes a program memory for storing a control program; a CPU for controlling operation of the electronic percussion instrument in accordance with the control program stored in the program memory; a storage device for storing: (1) a plurality of trigger data sets each of which includes at least one sensitivity setting parameter for setting sensitivity to the trigger signal; and (2) a plurality of drum kits each of which includes pad setting data for setting the tone color assigned to the at least one pad source and link data for designating one of the plurality of trigger data sets; and a setting operation input unit for selecting a drum kit from among the plurality of drum kits. The CPU is coupled to the storage device and the setting operation input unit and operative under the control program for setting the sensitivity to the trigger signal on the basis of the at least one sensitivity setting parameter included in the trigger data set designated by the link data included in the drum kit selected by the setting operation input unit.

Embodiments of the invention may also be described as a method of operating an electronic percussion instrument which generates, in accordance with a trigger signal output from at least one pad source, a musical performance tone of a tone color assigned to the at least one pad source. The method comprises (1) manually selecting a drum kit from among a plurality of drum kits, each drum kit including pad setting data for setting the tone color assigned to the at least one pad source; and (2) in response to manually selecting the drum kit, automatically, electronically setting a sensitivity of the trigger signal.

According to embodiments of the present invention, a simple selection of a drum kit for setting tone colors of pad sources from among drum kits results in automatic designation of a trigger data set on the basis of link data included in the drum kit. Furthermore, respective sensitivities of the respective pad sources are set in accordance with the sensitivity setting parameters included in the trigger data set. That is, the electronic percussion instrument of the present invention, in a simple operation, allows a user to make settings on the respective sensitivities of the pad sources, also realizing appropriate sensitivities corresponding to the respective tone colors.

DESCRIPTION OF THE PREFERRED EMBODIMENT

An embodiment of the present invention will now be described with reference to the drawings. In the explanation about the structure of the electronic percussion instrument of the embodiment, the closest/farthest sides of the electronic percussion instrument and the longitudinal/lateral (right/left) directions indicate the respective directions seen by a player of a later-described electronic percussion instrument 1.

Figure 4:
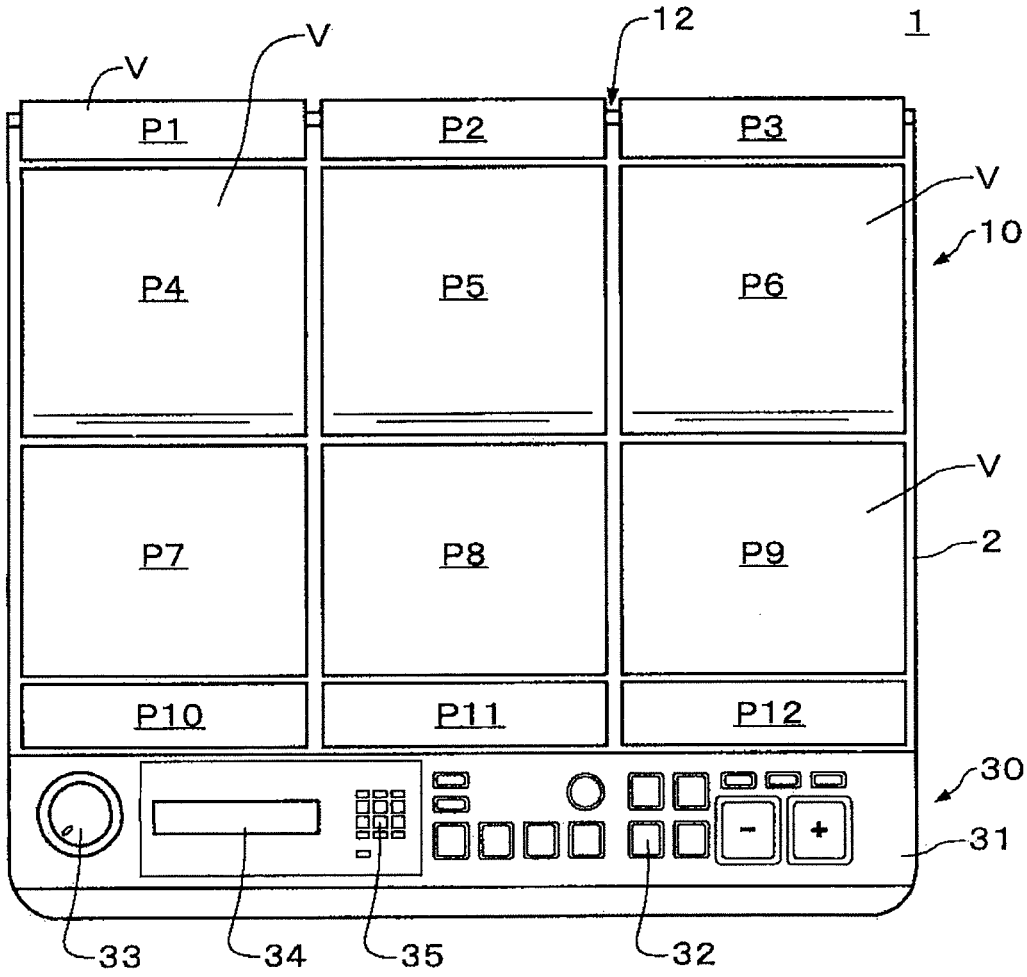
FIG. 4 is a top view of the electronic percussion instrument of the embodiment.
Figure 5A:
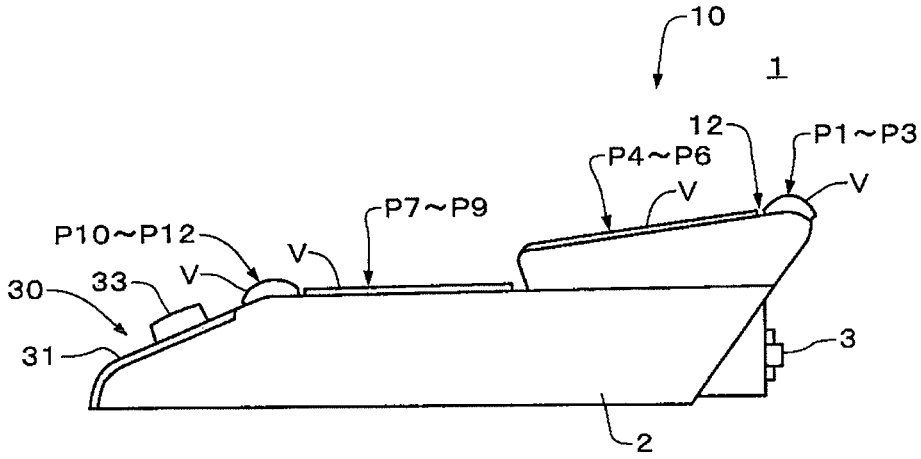
FIG. 5A is a side view of the electronic percussion instrument of the embodiment.
Figure 5B:
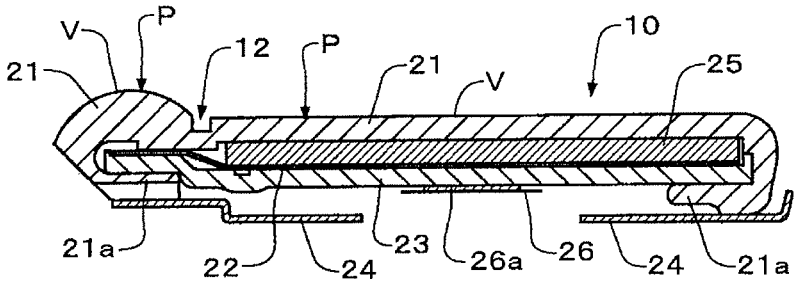
FIG. 5B is a schematic sectional view of pads.

FIG. 4, FIG. 5A and FIG. 5B indicate the electronic percussion instrument 1 of an embodiment of the present invention. FIG. 4 is a top view of the electronic percussion instrument 1. FIG. 5A is a side view of the electronic percussion instrument 1. FIG. 5B is a schematic sectional view of later-described pads. The electronic percussion instrument 1, which is a tabletop electronic musical instrument, is housed in a case 2 which is approximately flat in form. On the farthest side of the top surface of the case 2, a performance operating portion 10 formed of a plurality of pads P1 to P12 is provided, while a setting operating portion (a setting operation input unit) 30 having a panel 31 is placed at the corners of the closest side. On the rear surface of the case 2, as indicated in FIG. 5A, a terminal portion 3 having a plurality of terminals for connection for power supply and connection with external apparatuses is provided.

The performance operating portion 10 is arranged such that the top surface of the case 2 is covered with the performance operating portion 10. The outline of the performance operating portion 10 is approximately rectangular. More specifically, the performance operating portion 10 is sectioned to form a lattice in the longitudinal and lateral directions seen from the player (from the closest side) to place the pads P1 to P12 in the sections, respectively. In this embodiment, the performance operating portion 10 is divided into four sections (four rows) in the longitudinal direction and three sections (three columns) in the lateral direction to have the twelve pads P1 to P12 in total.

Among the pads P1 to P12, the three pads P1, P2, P3 placed on the farthest row and the three pads P10, P11, P12 placed on the closest row are shaped like a rectangle which is long sideways, as indicated in FIG. 4, and have a three-dimensional drumhead V protruding to have a cylindrical surface whose axial direction coincides with the lateral direction as indicated in FIG. 5A. The other six pads P4 to P9 are approximately shaped like a square as indicated in FIG. 4, and have a flat drumhead V as indicated in FIG. 5A.

The flat pads P4 to P9 are arranged to slightly lean down toward the closest side of the case 2 so that the respective drumheads V can face the player. Furthermore, the angle of inclination of the farther three pads P4 to P6 is greater than that of the closer three pads P7 to P9, with a step being provided between the farther three pads P4 to P6 and the closer three pads P7 to P9. Such an arrangement facilitates player's visual recognition of the respective positions of the pads, also enhancing operability of the electronic percussion instrument 1. The pads P1 to P3, P10 to P12 are suitable for performance (rim shot, etc.) in which the player strikes the drumhead V protruding to have a cylindrical surface with the body of a drumstick. The pads P4 to P9 are suitable for performance in which the player strikes the flat drumhead V with the tip of a drumstick. Performance on the pads P1 to P12 is not limited to striking the pads with sticks but may include striking the pads with part of the player's body such as hands and pressing the pad with the player's hand which corresponds to muting and choking.

Hereafter, in a case where there is no need to distinguish between the twelve pads P1 to P12, the numbers "1 to 12" will be omitted. As indicated in FIG. 5B, the drumhead of the pad P is formed of a sheet surface member 21 which is made of an elastic material such as rubber. Between the neighboring pads P, a groove 12 of a lattice pattern is provided in order to section the pads P1 to P12. On the underside of the surface member 21, a flat elastic member 25 made of rubber or the like is provided. On the undersurface of the elastic member 25, a contact sensor (sheet switch) 22 placed on a reinforcing plate (pad body) 23 is provided. The contact sensor 22, which is a sheet-type pressure sensor, detects a player's operation of pressing the drumhead V and the position of striking.

Under the reinforcing plate 23 on which the contact sensor 22 is placed, an edge portion 21 a of the surface member 21 extending from the top surface of the pad P is provided so that the edge portion 21*a* is rolled. By such a configuration, the reinforcing plate 23 is elastically supported through the edge portion 21*a* of the surface member 21 on a base portion 24 (part of the case 2 and the like) placed below the performance operating portion 10. On the underside of the reinforcing plate 23, a strike sensor 26 which is shaped like a small plate and has surface contact with the reinforcing plate 23 is provided. The strike sensor 26 employs a piezoelectric element or the like which detects vibration caused by striking of the pad P and outputs electric signals. The strike sensor 26, which is stuck on the undersurface of the reinforcing plate 23 with a piezoelectric tape (cushion member) 26*a*, detects the force or strength of striking when the pad P is struck.

On the panel 31 of the setting operating portion 30, as indicated in FIG. 4, various operating keys 32 such as cursor switches and input switches, a knob 33 for volume setting, a display portion 34 formed of a liquid crystal panel, and an LED 35 for indicating which pad P is operated are arranged. Near the panel 31, a tone output portion (not shown) having an internal speaker for outputting various kinds of tones such as musical performance tones is also provided. The display portion 34 displays a screen for allowing the player to make various settings.

Figure 1:
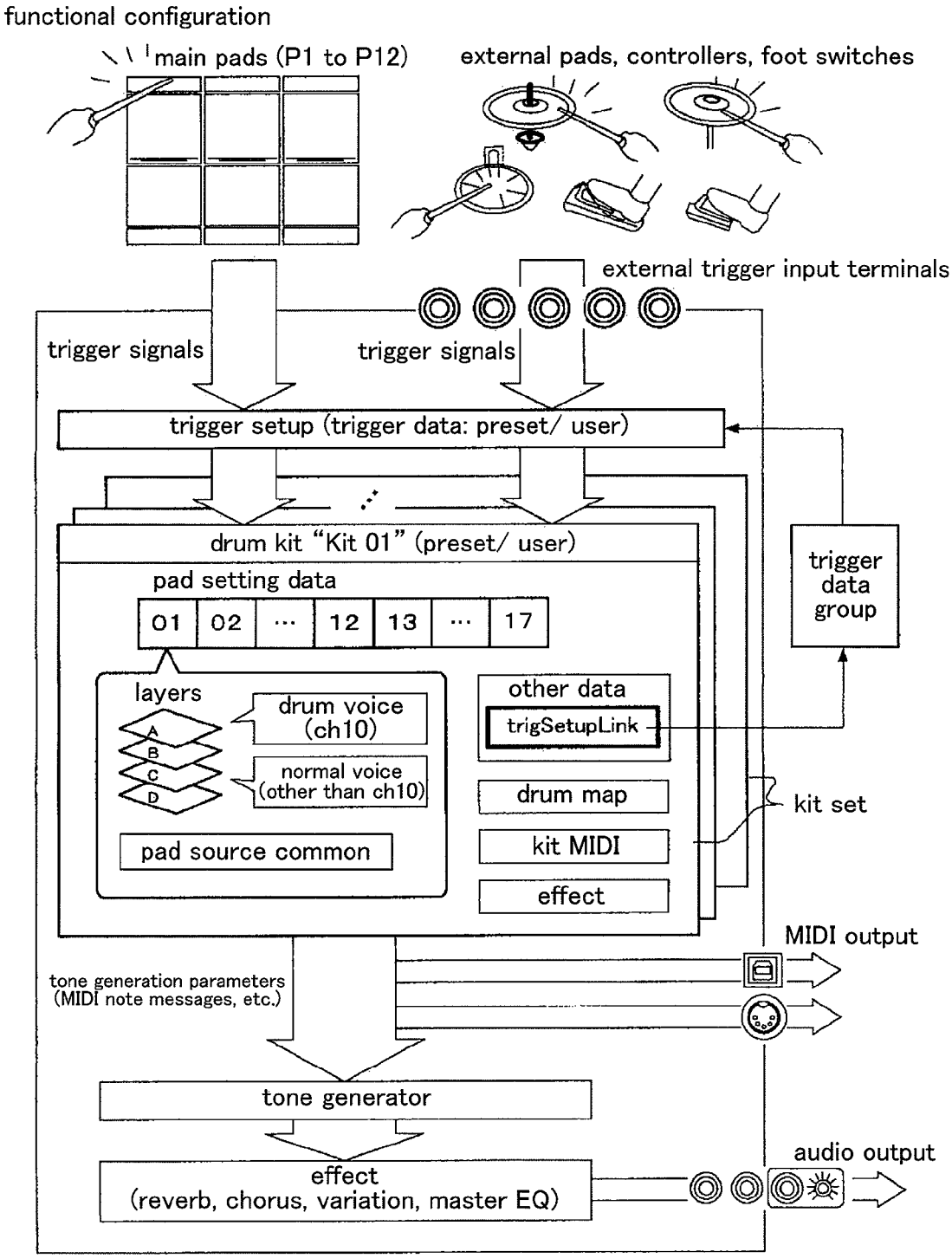
FIG. 1 is a diagram indicating a functional configuration of a main part of an electronic percussion instrument according to an embodiment of the present invention.
Figure 2:
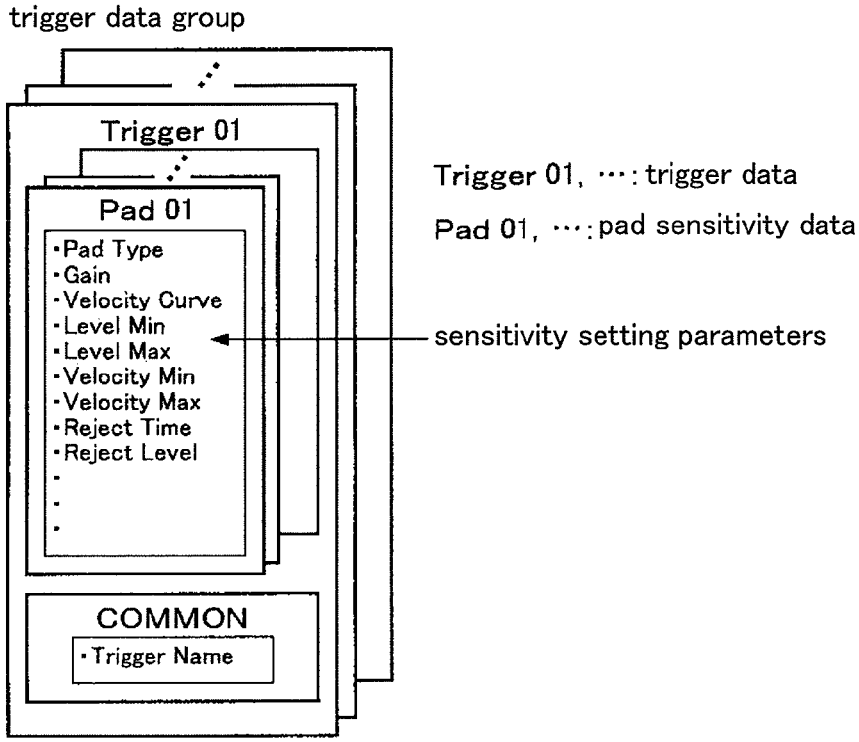
FIG. 2 is a diagram indicating details on a trigger data group of the embodiment.
Figure 3:
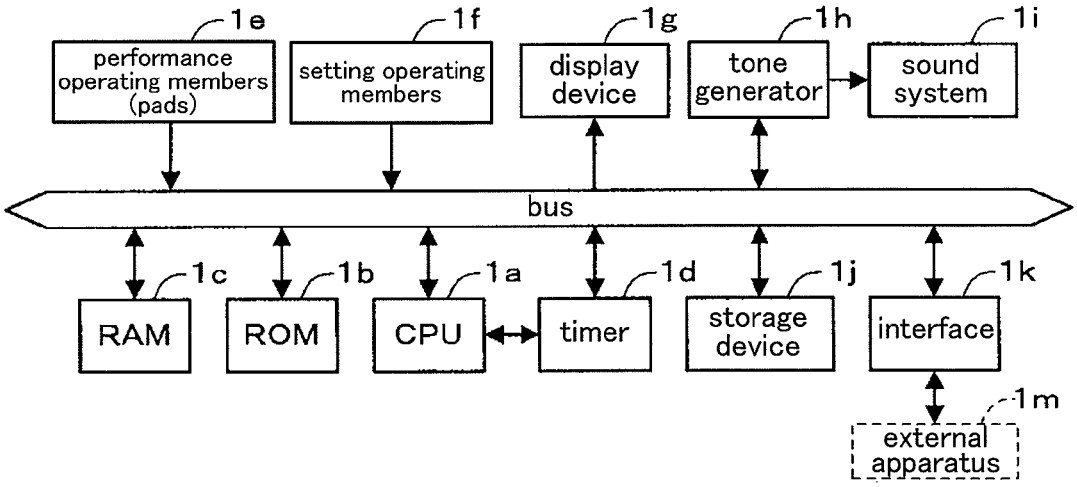
FIG. 3 is a block diagram of the electronic percussion instrument of the embodiment.

FIG. 1 indicates a functional configuration of a main part of the electronic percussion instrument 1 of the embodiment. FIG. 2 indicates details on a trigger data group of the embodiment. FIG. 3 is a block diagram of the electronic percussion instrument 1 of the embodiment. As indicated in FIG. 3, the electronic percussion instrument 1 of the embodiment has a central processing unit or CPU 1*a*, a read only memory or ROM 1*b*, a random access memory or RAM 1*c* and a timer 1*d* which serve as a control portion. In addition, the electronic percussion instrument 1 also has performance operating members 1*e* formed of the pads P1 to P12, and the contact sensor 22 and the strike sensor 26 provided for the pads P1 to P12, setting operating members 1*f* formed of the various operating keys 32, the knob 33 and the like, a display device 1*g* formed of the display portion 34 and the LED 35, a tone generator 1*h*, a sound system 1*i*, a storage device 1*j* and an interface 1*k*.

In the storage device 1*j* which is storage means formed of a flash ROM, the trigger data group and data of a kit set formed of drum kits for setting tone colors and the like which will be described later are stored. The interface 1*k* is used in order to transmit/receive data to/from an external apparatus 1*m* connected via the terminal portion 3. As indicated in FIG. 1, the terminal portion 3 has external trigger input terminals for connecting external elements such as drum pads, controllers, and foot switches of a drum set serving as the external apparatus (external percussion instrument) 1*m* with the electronic percussion instrument 1. Those which output trigger signals of the pads P1 to P12 and the external trigger input terminals (or the external elements connected to them) are referred to as "pad sources".

Using a working area of the RAM 1*c*, serving as a program memory, the CPU 1*a* controls the entire electronic percussion instrument 1 in accordance with a control program stored in the ROM 1*b*. For example, the CPU 1 controls what is displayed on the display portion 34 of the display device 1*g*, also detecting operation of the setting operating members 1*f* to perform processing in accordance with the detected operational event of the setting operating members 1*f*. By such workings, a drum kit is selected from among a later-described drum kit sets in accordance with the user's operation. Furthermore, the CPU 1 also controls editing of pad setting data included in the drum kit and various settings such as settings on parameters for setting the sensitivity of the trigger data included in the trigger data group.

In accordance with trigger signals generated on the basis of operational events of the performance operating members 1 (the pads P1 to P12) or trigger signals input from the external trigger input terminals through the interface 1*k*, the CPU 1 refers to the drum kit stored in the storage device 1*j*, generates tone generation parameters formed of MIDI note messages and the like, and outputs the tone generation parameters to the tone generator 1*h*. Thus, the tone generator 1*h* generates various musical performance tones such as drum tones (drum voices) and musical tones of other musical instruments (normal voices). The timer 1*d* is a circuit for generating signals which define timings of automatic accompaniment and timings at which click tones are to be generated.

As indicated in FIG. 1, sets of drum kit data Kit 01, etc. form the kit set. These drum kits include a plurality of preset kits (e.g., 30 different kinds) and a plurality of user kits (e.g., up to 200 different kinds). The drum kit indicated in detail in FIG. 1 is an example drum kit selected by the user from the kit set. Each drum kit has seventeen sets of pad setting data indicated by "01 to 12" and "13 to 17". The pad setting data sets "01 to 12" correspond to the twelve pads P1 to P12, respectively. The pad setting data sets "13 to 17" correspond to the five external trigger input terminals, respectively. In this embodiment, each pad setting data set is formed of four layers of A, B, C and D as indicated as an example of "01". Each layer is assigned a note number, a MIDI channel, a gate time and the like, so that a drum voice (in a case where the MIDI channel is ch 10) or a normal voice (in a case where the MIDI channel is a channel other than ch 10) is assigned to the layer.

Each pad setting data set has pad source common data which is common to its corresponding pad source. The pad source common data includes data on MIDI massage type and data on stack/alternate mode. The MIDI massage type indicates the type of information assigned to the pad setting data. In a case where the message type is Control Change, more specifically, the pad setting data is to have information on Control Change. In a case where the message type is Program Change, the pad setting data is to have information on Program Change. In a case where the massage type is note, the pad setting data is able to make a voice assignment of the layer structure. In a case where the massage type is note, furthermore, the pad setting data may have wave data formed of sampling waveforms or pattern data such as accompaniment patterns, instead of voices, for example.

The data on stack/alternate mode contained in the pad source common data is data indicative of either "stack mode" or "alternate mode". The "stack mode" is a mode in which a striking of the pad results in simultaneous generation of a plurality of voices assigned to the pad. The "alternate mode" is a mode in which one of voices assigned to the pad is generated, switching in a certain order each time the pad is struck. The order of the switching among the assigned voices in the "alternate mode" can be defined by the user.

Each drum kit has data on a drum map, data on kit MIDI, data on effect, and other data common to the pad sources (or pad setting data sets) as a set. As the data on the drum map, the drum kit has data on the name of tone color (information for designating a drum voice), volume, tuning, pan (localization) and the like for respective note numbers corresponding to respective tone names "C#-1" to "A#5", for example, as a set. The drum map is referred to in a case where the MIDI channel of a layer is "ch 10". The data on the drum map is user programmable (editable). The data on the kit MIDI is data on the generation of a tone in a normal voice. The kit MIDI data has data on volume, pan, Program Change and the like for the respective MIDI channels "ch 1 to ch 9, ch 11 to ch 16" other than "ch 10" as a set. The kit MIDI is referred to in a case where the MIDI channel of a layer is a channel other than "ch 10". The type (tone color) of normal voice of the channel is determined according to the Program Change of the channel. The data on effect is data on variations, chorus, reverb and others for selecting type of effect for each drum kit.

The other data includes data on Trigger Setup Link as "link data". The Trigger Setup Link is data for specifying a location at which the trigger data contained in the trigger data group is stored. The trigger data specified on the basis of the Trigger Setup Link is to be used by a trigger setup function. By selecting a drum kit, more specifically, the later-described sensitivity setting parameters contained in the trigger data and the like are set so that the trigger setup function can use the set parameters. This function of making the settings is the function of setting the respective sensitivities of the respective pad sources all at once. The trigger setup function is realized by a program processing done by the CPU 1*b*.

As indicated in FIG. 2, the trigger data group is formed of a plurality of trigger data sets "Trigger 01", "Trigger 02", etc. FIG. 2 indicates details on a trigger data set of "Trigger 01", for example. The trigger data set includes plural (seventeen) pad sensitivity data sets "Pad 01", "Pad 02", etc. corresponding to the respective pad sources, and common data (COMMON) which stores a trigger name (Trigger Name) and is common to the respective pad sources. Each pad sensitivity data set "Pad 01", "Pad 02", etc. stores various sensitivity setting parameters such as Pad Type, Gain, Velocity Curve, Level Min, Level Max, Velocity Min, Velocity Max, Reject Time, and Reject Level.

The Pad Type is a parameter indicative of the type of a pad, that is, a parameter for distinguishing between the pads having the protruding drumhead V such as the pads P1 to P3 and P10 to P12, and the pads having the flat drumhead V such as the pads P4 to P9, or for distinguishing among those connected to the external trigger input terminals. The Gain is a parameter indicative of the gain of a trigger signal input from the pad. As the value of the gain increases, the strength or force with which the user is required to strike the pad in order to emit a musical performance tone becomes smaller. The Velocity Curve is a parameter for specifying the type of velocity curve table indicative of velocity (tone volume of a musical tone signal) values with respect to trigger signal level. The velocity curve tables are stored in the storage device 1*j* separately.

The Level Min is a parameter indicative of the smallest value of the level of a trigger signal which outputs a velocity value. The Level Max is a parameter indicative of the largest value of the level of a trigger signal which increases a velocity value. The Velocity Min is a parameter indicative of a velocity value corresponding to the smallest value of the level indicated by the Level Min. The Velocity Max is a parameter indicative of a velocity value corresponding to the largest value of the level indicated by the Level Max. The Reject Time is a parameter about time for preventing generation of double-triggering caused by rebounding of a stick or beater. If a trigger signal is generated within the set time, the trigger signal is regarded as double-triggering, so that the pad refrains from emitting a tone on the basis of the trigger signal. The Reject Level is a level parameter for preventing crosstalk caused by vibration and the like during musical performance. In a case where a trigger signal is below this level, the trigger signal is regarded as crosstalk, so that the trigger signal will not result in emission of a tone.

Next, the trigger setup function will be described. By striking any of the main pads P1 to P12, a pad source signal and a trigger signal are obtained. The pad source signal indicates a struck position, that is, a struck pad P1 to P12 detected by the contact sensor 22. The trigger signal is a signal indicative of a strike with a stick, hand or the like against the pad detected by the strike sensor 26. The value of the trigger signal increases with an increase in the strength or force with which the main pad P1 to P12 is struck. To the five external trigger input terminals, as described above, the external pads, the controllers, the foot switches and the like of the other drum set are allowed to connect. From these external elements as well, therefore, trigger signals can be input. In such a case, pad sources are identified on the basis of the respective positions of the input terminals. The pad source signals and trigger signals transmitted from these pad sources are to be processed by the trigger setup function.

The trigger setup function controls sensitivities to trigger signals transmitted from the pad sources in accordance with the respective sensitivity setting parameters provided for the respective pad sources. When an input of a trigger signal is detected on the basis of the sensitivity set by the trigger setup function, tone generation parameters are generated for the tone generator on the basis of various kinds of data contained in a drum kit.

More specifically, when a pad source signal and a trigger signal are supplied from the main pad P1 to P12, the trigger setup function multiplies the supplied trigger signal by the gain included in the pad sensitivity data (the sensitivity setting parameters) corresponding to the pad designated from among the main pads P1 to P12 by the pad source signal. The pad sensitivity data has been provided for the trigger setup function by a selection of a drum kit. In a case where a trigger signal is supplied from the external trigger input terminal, the trigger setup function multiplies the supplied trigger signal by the gain included in pad sensitivity data identified on the basis of the external input terminal. The level of the trigger signal multiplied by the gain is then compared with the Level Min included in the pad sensitivity data in which the gain is also included. When the trigger signal level is equal to the Level Min or more, the trigger signal is regarded as a signal which is to trigger generation of a musical tone signal. By referring to a velocity curve table designated by a velocity curve included in the pad sensitivity data in which the gain is also included, the trigger signal level is converted into a velocity. When the trigger signal level is smaller than the Level Min, the trigger signal is not regarded as a signal which is to trigger generation of a musical tone signal, resulting in no more processing.

As described above, when the trigger signal transmitted from the struck pad is regarded as a signal which is to trigger generation of a musical tone signal and the amplified trigger signal level is converted into the velocity, the pad setting data corresponding to the pad source is referred to, so that note numbers, MIDI channels and the like assigned to layers of the pad setting data are read out. In a case where the MIDI channel is ch 10, data on voice (tone color name), volume, tuning, pan and the like which is included in the drum map and corresponds to the note number is supplied to the tone generator along with the other data on effect and the like as tone generation parameters. The tone generator then generates a musical tone signal of the drum voice. In a case where the MIDI channel is a channel other than ch 10, data on Program Change (tone color specification data), volume, pan and the like included in the kit MIDI corresponding to the note number and the MIDI channel is supplied to the tone generator along with the other data on effect and the like as tone generation parameters. The tone generator then generates a digital musical tone signal of the normal voice. Because the tone generation parameters supplied to the tone generator include the converted velocity, the tone volume of the musical tone signal which is to be generated is controlled in accordance with the velocity. To the digital musical tone signal, various kinds of effects are added by an effect function, so that an audio signal having the effects is to be output.

Figure 6:
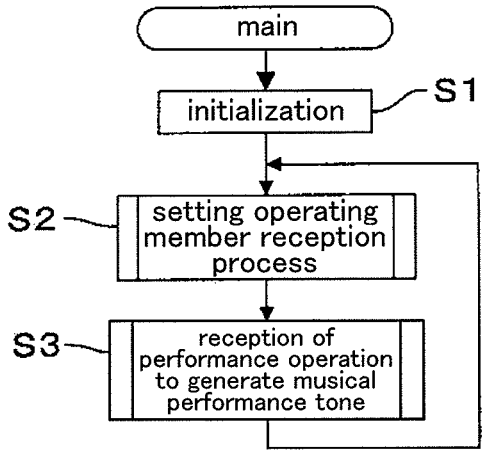
FIG. 6 is a flowchart of a main process of the embodiment.
Figure 7:
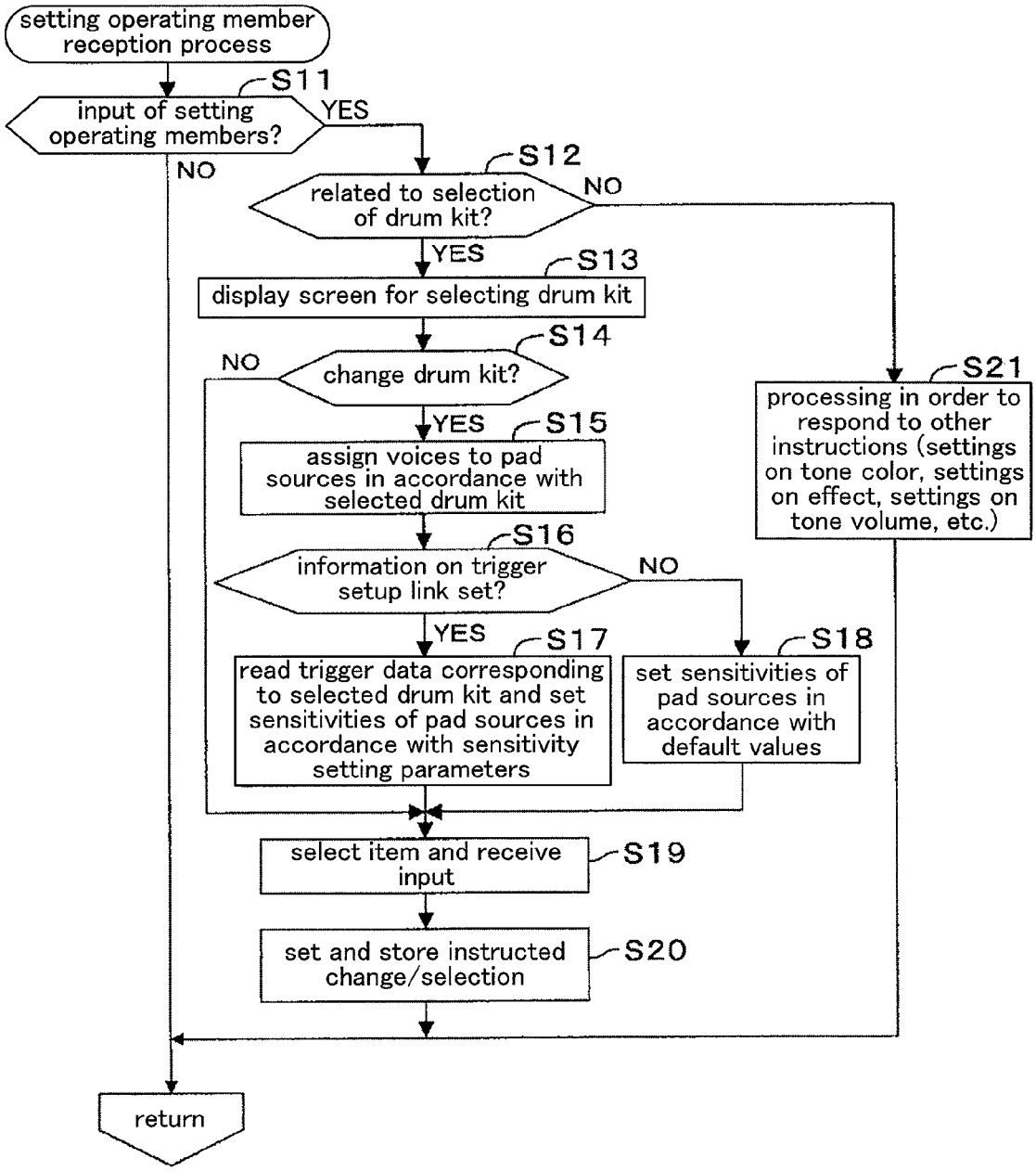
FIG. 7 is a flowchart of a setting operating member reception process of the embodiment.

FIG. 6 is a flowchart of a main process. FIG. 7 is a flowchart of a setting operating member reception process (sub-routine). The main process is started when power of the electronic percussion instrument 1 is turned on. In step S1, an initialization is performed. In step S2, the setting operating member reception process indicated in FIG. 7 is performed. In step S3, an operation of the performance operating members (pads or the like) is received to carry out processing for generating a musical performance tone. Then, the process returns to step S2. In the setting operating member reception process of FIG. 7, when there is no input of the setting operating members in step S11, the process directly returns to the main routine. When there is an input of the setting operating members in step S11, the process proceeds to step S12 and later steps to carry out processing in accordance with the input of the setting operating members.

When it is determined in step S12 that the input is related to the selection of a drum kit, the process proceeds to step S13 to display a screen for selecting a drum kit. When it is determined in step S14 that a drum kit is selected, the process proceeds to step S15 to assign voices (drum voices or normal voices) to the pad sources, respectively, in accordance with the pad setting data of the selected drum kit. In step S16, it is determined whether information on the trigger setup link of the drum kit is set. When it is determined that the information has been set, the process proceeds to step S17 to read out the corresponding trigger data from the trigger data group on the basis of the trigger setup link of the selected drum kit to set respective sensitivities of the respective pad sources in accordance with the sensitivity setting parameters of the trigger data. When information on the trigger setup link of the drum kit is not set, the process proceeds to step S18 to set the respective sensitivities of the respective pad sources in accordance with sensitivity setting parameters (independent of kits) stored as default values.

In steps S19, S20, a determination whether an input for other items is to be received, a reception of an input for other items of the drum kit, and storage of user's instructions such as a change or selection in the storage device 1*j* are done. For example, settings on the entire drum kit, effects such as reverb and chorus, and settings on the drum kit such as tempo are made. In step S21, processing is done in order to respond to user's instructions other than those regarding the drum kit.

When a supply of a pad source signal and a trigger signal from the main pad P1 to P12 or a supply of a trigger signal from the external trigger input terminal is detected by the reception of the operation of the performance operating members (such as pads) in step S3, the above-described trigger setup function is realized by step S2. More specifically, when the input of the trigger signal for generating a musical tone signal in accordance with the sensitivity set by the trigger setup function is detected, tone generation parameters including velocity corresponding to the magnitude of the trigger signal are generated on the basis of various kinds of data of the drum kit. The generated tone generation parameters are then supplied to the tone generator 1*h*, so that the tone generator 1*h* generates the musical tone signal to emit a musical performance tone corresponding to the generated musical tone signal from the sound system 1*i*.

Although the above-described embodiment is designed such that each pad setting data set is structured as layers so that a plurality of drum voices may be assigned to one pad source, the embodiment may be modified such that a drum voice of one kind is assigned to one pad source.

In addition, the embodiment is designed such that the trigger signal level multiplied by gain is compared with the Level Min included in the pad sensitivity data (sensitivity setting parameters) before the determination whether a musical tone signal is to be generated or not. Instead of this scheme, however, the embodiment may be modified such that the trigger signal level is compared with the Level Min without multiplying the trigger signal level by gain before the determination whether a musical tone signal is to be generated or not. In this modification, more specifically, the trigger signal level input to the trigger setup function is compared with the previously stored minimum level of the pad source that has output the trigger signal. In this modification, when the trigger signal level is equal to the minimum level or more, a musical tone signal is to be generated. When the trigger signal level is below the minimum level, any musical tone signal will not be generated.

Figure 8:
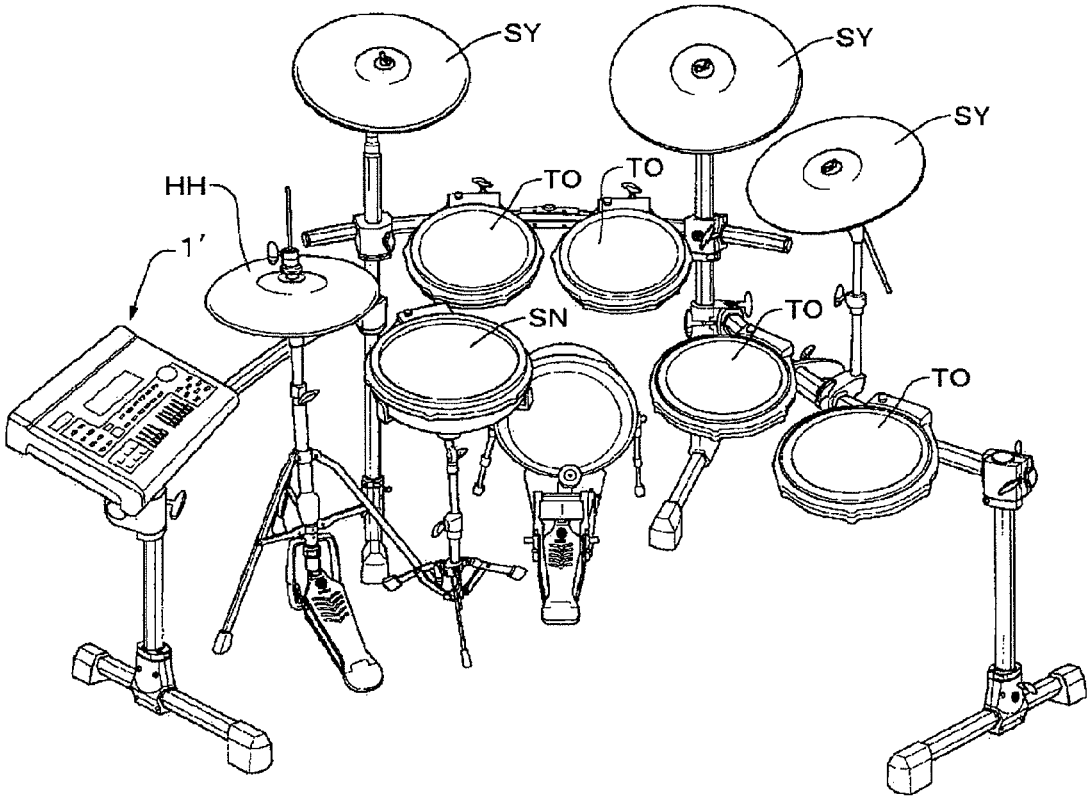
FIG. 8 is a diagram indicating a modified example of the electronic percussion instrument of the embodiment of the present invention.

The electronic percussion instrument 1 of the above-described embodiment has the pads P1 to P12 on its main unit. However, the electronic percussion instrument 1 may be modified as an electronic percussion instrument 1' indicated in FIG. 8, for example, such that external pads are connected to the electronic percussion instrument 1'. In this example, the pads of a drum set include a snare SN, four toms TM, a high-hat HH, and three cymbals SY, which are connected to the electronic percussion instrument 1', respectively, with cables which are not shown. Each of these pads is designed to have split strike zones so that each split strike zone may have a different tone color.

In a case of the snare SN or the tom TM, for example, possible tone colors include a tone color of head shot by which the drumhead is struck, a tone color of open rim shot by which a rim section closest to the player is struck, and a tone color of closed rim shot by which a rim section farthest to the player is struck. In a case of high-hat HH, possible tone colors include a tone color of bow shot by which a section situated between a cup and an edge is struck, and a tone color of edge shot by which the edge is struck. In a case of the cymbals SY, possible tone colors include a tone color of bow shot by which a section situated between a cup and an edge is struck, a tone color of edge shot by which the edge is struck, and a tone color of bell shot by which the cup is struck. Respective trigger signals corresponding to the respective tone colors (respective zones to strike) of each pad are to be input from the external trigger input terminals. That is, the respective external trigger input terminals are regarded as respective pad sources of the electronic percussion instrument 1'. In the electronic percussion instrument 1' of the modified embodiment, the respective sensitivities of the respective pad sources (strike zones) may be set all at once.

As for the electronic percussion instrument 1', a set of sensitivity setting parameters provided for the respective pad sources is a set of trigger data. Similarly to the above-described embodiment, the electronic percussion instrument 1' stores a trigger data group formed of plural sets of trigger data. Furthermore, respective pad setting data sets of the respective drum kits are stored to correspond to the respective pad sources. In addition, the other data on trigger setup link included in each drum kit is also stored similarly.

What is claimed is:

1. An electronic percussion instrument which generates, in accordance with a trigger signal output from at least one pad source, a musical performance tone of a tone color assigned to the at least one pad source, the electronic percussion instrument comprising:

a program memory for storing a control program;

a CPU for controlling operation of the electronic percussion instrument in accordance with the control program stored in the program memory;

a storage device for storing:

a plurality of trigger data sets each of which includes at least one sensitivity setting parameter for setting sensitivity to the trigger signal;

a plurality of drum kits each of which includes pad setting data for setting the tone color assigned to the at least one pad source and link data for designating one of the plurality of trigger data sets;

a setting operation input unit for selecting a drum kit from among the plurality of drum kits; and the CPU coupled to the storage device and the setting operation input unit and operative under the control program for setting the sensitivity to the trigger signal on the basis of the at least one sensitivity setting parameter included in the trigger data set designated by the link data included in the drum kit selected by the setting operation input unit, wherein the at least one sensitivity setting parameter includes data indicative of a gain which amplifies a level of the trigger signal.

2. The electronic percussion instrument according to claim 1, wherein, the at least one sensitivity setting parameter includes data indicative of a minimum level of the trigger signal, the minimum level allowing generation of a musical tone signal in accordance with the trigger signal.

3. The electronic percussion instrument according to claim 1, wherein, the at least one sensitivity setting parameter includes data for setting a characteristic of variations in tone volume of a musical tone signal which is generated according to a level of the trigger signal.

4. The electronic percussion instrument according to claim 1, wherein, the at least one pad source is provided on the electronic percussion instrument, the at least one pad source generating the trigger signal in response to striking of the at least one pad source.

5. The electronic percussion instrument according to claim 1, wherein, the at least one pad source is an external percussion instrument separated from the electronic percussion instrument, and supplies the trigger signal to an external connection terminal of the electronic percussion instrument in response to a strike of the external percussion instrument.

6. The electronic percussion instrument according to claim 1, wherein, a level of the trigger signal varies according to a magnitude of a force with which a pad of the at least one pad source is struck.

7. The electronic percussion instrument according to claim 1, wherein, the at least one pad source is a pad struck with a stick or a hand.

8. The electronic percussion instrument according to claim 1, wherein, the electronic percussion instrument generates, in accordance with a plurality of trigger signals output from a plurality of pad sources, respectively, musical performance tones of tone colors assigned to the plurality of pad sources, respectively;

the respective plurality of trigger data sets stored in the storage device each include a plurality of sensitivity setting parameters for setting plural respective sensitivities to the plurality of trigger signals;

the respective plurality of drum kits stored in the storage device each include a plurality of pad setting data sets for setting tone colors assigned to the plurality of pad sources, respectively, and link data for designating respective ones of the plurality of trigger data sets; and the CPU sets the plural respective sensitivities to the plurality of trigger signals on the basis of the plurality of sensitivity setting parameters included in the designated respective ones of the plurality of trigger data sets.

9. The electronic percussion instrument according to claim 8, wherein, the plurality of sensitivity setting parameters includes:

data indicative of gains which amplify levels of the plurality of trigger signals;

data indicative of minimum levels of the plurality of trigger signals, the minimum levels allowing generation of musical tone signals in accordance with the plurality of trigger signals; and data for setting characteristics of variations in tone volumes of the musical tone signals which are generated according to levels of the plurality of trigger signals.

10. The electronic percussion instrument according to claim 9, wherein, levels of the plurality of trigger signals vary according to magnitudes of a force with which a pad of the at plurality of pad sources are struck.

11. The electronic percussion instrument according to claim 8, wherein, the plurality of pad sources are pads struck with a stick or a hand.

12. The electronic percussion instrument according to claim 8, wherein, the electronic percussion instrument includes the plurality of pad sources.

13. The electronic percussion instrument according to claim 8, wherein, some of the plurality of pad sources are included in one or more external percussion instruments separated from the electronic percussion instrument, and the one or more external percussion instruments supply some of the plurality of trigger signal to an external connection terminal of the electronic percussion instrument in response to striking the some of the plurality of pad sources included in the one or more external percussion instruments.

14. The electronic percussion instrument according to claim 13, wherein, others of the plurality of pad sources are part of the electronic percussion instrument.

15. A method of operating an electronic percussion instrument which generates, in accordance with a trigger signal output from at least one pad source, a musical performance tone of a tone color assigned to the at least one pad source, the method comprising:

manually selecting a drum kit from among a plurality of drum kits, each drum kit including pad setting data for setting the tone color assigned to the at least one pad source; and in response to manually selecting the drum kit, automatically, electronically setting a sensitivity of the trigger signal, wherein automatically setting the sensitivity of the trigger signal includes automatically setting data indicative of a gain which amplifies a level of the trigger signal.

16. The method of claim 15 wherein automatically setting the trigger signal includes setting data indicative of:

a minimum level of the trigger signal, the minimum level allowing generation of a musical tone signal in accordance with the trigger signal; and data for setting a characteristic of a variations in a tone volume of the musical tone signal which is generated according to a level of the trigger signal.

17. A method of operating an electronic percussion instrument which generates, in accordance with a plurality of trigger signals output from a plurality of pad sources, respectively, musical performance tones of tone colors assigned to the plurality of pad sources respectively, the method comprising:

manually selecting a drum kit from among a plurality of drum kits, each drum kit including a plurality of pad setting data for setting the tone colors assigned to the respective plurality of pad sources; and in response to manually selecting the drum kit, automatically, electronically setting sensitivities of the plurality of trigger signals, wherein automatically electronically setting the sensitivities of the plurality of trigger signals includes automatically setting data indicative of gains which amplify levels of the plurality of trigger signals.

* * * * *